US011678701B2

(12) United States Patent
Harrison

(10) Patent No.: US 11,678,701 B2
(45) **Date of Patent: *Jun. 20, 2023**

(54) GARMENT FOR USE WITH SEAT RESTRAINTS AND METHOD OF USE THEREFOR

(71) Applicant: Jennifer Rozena Harrison, Ithaca, MI (US)

(72) Inventor: Jennifer Rozena Harrison, Ithaca, MI (US)

( * ) Notice: Subject to any disclaimer, the term of this patent is extended or adjusted under 35 U.S.C. 154(b) by 179 days.

This patent is subject to a terminal disclaimer.

(21) Appl. No.: 17/152,444

(22) Filed: Jan. 19, 2021

(65) Prior Publication Data

US 2021/0137178 A1 May 13, 2021

Related U.S. Application Data

(62) Division of application No. 16/114,118, filed on Aug. 27, 2018, now Pat. No. 10,918,140.

(60) Provisional application No. 62/628,197, filed on Feb. 8, 2018.

(51) Int. Cl.
*A41D 3/00* (2006.01)
*A41D 13/12* (2006.01)

(52) U.S. Cl.
CPC ..... *A41D 3/00* (2013.01); *A41D 13/129* (2013.01); *A41D 13/1236* (2013.01); *A41D 2400/10* (2013.01); *A41D 2400/70* (2013.01); *A41D 2600/00* (2013.01)

(58) Field of Classification Search
CPC .... A41D 13/0007; A41D 13/129; A41D 1/04; A41D 3/00; A61F 5/3746; A61F 13/06
USPC ..... 2/79.8, 83, 69, 69.5, 93
See application file for complete search history.

(56) References Cited

U.S. PATENT DOCUMENTS

| | | | | | |
|---|---|---|---|---|---|
| 1,929,263 | A * | 10/1933 | Sork | A41B 13/06 | 2/69.5 |
| 4,683,594 | A * | 8/1987 | Feinberg | A41D 13/1236 | 2/105 |
| 4,787,594 | A * | 11/1988 | Ikegaya | B60N 2/1803 | 248/421 |
| 4,832,053 | A * | 5/1989 | McCarthy | A61F 5/3784 | 128/869 |
| 5,950,261 | A * | 9/1999 | Hay | A41B 13/06 | 5/655 |
| 5,960,480 | A * | 10/1999 | Neustater | A62B 35/04 | 2/456 |
| 7,519,911 | B2 * | 4/2009 | Friedman | H04L 9/40 | 715/752 |
| 7,594,281 | B1 * | 9/2009 | Stinson | A62B 17/003 | 2/310 |
| 7,954,172 | B2 * | 6/2011 | Hepler | B60R 22/14 | 2/75 |
| 10,918,140 | B2 * | 2/2021 | Harrison | A41D 3/00 | |
| 2006/0037124 | A1 * | 2/2006 | Cho | A41D 13/1245 | 2/114 |

(Continued)

*Primary Examiner* — Gloria M Hale

(57) ABSTRACT

A garment is configured to facilitate wearing by an occupant of a seat assembly with a plurality of shoulder straps, such as a wheelchair or child car seat. The garment has an inner surface, an outer surface, and defines a slot that extends from the inner surface to the outer surface. The slot is sufficiently sized and positioned such that the shoulder straps are insertable through the slot when the garment is on the seating assembly.

9 Claims, 10 Drawing Sheets

(56) References Cited

U.S. PATENT DOCUMENTS

| | | | | |
|---|---|---|---|---|
| 2009/0144876 | A1* | 6/2009 | Pena | A41D 13/0007 5/81.1 R |
| 2011/0030118 | A1* | 2/2011 | Pratchett | A62B 35/0025 2/243.1 |
| 2015/0305420 | A1* | 10/2015 | Daniels | A41D 1/02 2/93 |
| 2019/0239576 | A1* | 8/2019 | Harrison | A41D 11/00 |

* cited by examiner

GARMENT FOR USE WITH SEAT RESTRAINTS AND METHOD OF USE THEREFOR

CROSS-REFERENCE TO RELATED APPLICATION

This application is a divisional application of U.S. patent application Ser. No. 16/114,118, filed Aug. 27, 2018 and issued as U.S. Pat. No. 10,918,140 on Feb. 16, 2021, which claims the benefit of U.S. Provisional Application No. 62/628,197, filed Feb. 8, 2018, both of which are hereby incorporated by reference in their entireties.

TECHNICAL FIELD

This disclosure relates to garments for use in seat assemblies having harness restraint systems.

BACKGROUND

Wheelchair users and their caregivers often encounter difficulty with applying outerwear such as winter coats. This difficulty may be exacerbated if the wheelchair includes a harness to secure the occupant. To overcome this difficulty, a caregiver may place a blanket over a wheelchair occupant and then tuck the edges of the blanket between the wheelchair's seat and the occupant. However, the blanket may become loose and come into contact with the wheelchair's wheels or slide off. Other alternatives for providing a wheelchair user with insulative clothing include a poncho or a wheelchair cover. These alternatives do not surround the occupant and may leave the back side of the occupant without adequate insulation. Similar problems occur with other seating devices having harness systems, such as infant or child car seats.

SUMMARY

A garment for an occupant of a seat assembly is provided. The seat assembly has a lower seat portion, a seatback portion, and first and second shoulder straps mounted with respect to the lower seat portion and the seatback portion. The garment includes a piece of fabric material defining an inner surface and an outer surface. The garment has a first edge and a second edge; the piece of fabric material is configurable such that the inner surface defines an enclosed space having an opening between the first and second edges. The enclosed space is configured to enclose the torso and arms of the occupant. A slot extends from the inner surface to the outer surface and is sufficiently sized and positioned such that the first and second shoulder straps are insertable through the slot when the garment is on the seating assembly.

The above features and advantages and other features and advantages of the present disclosure are readily apparent from the following detailed description of the best modes for carrying out the disclosure when taken in connection with the accompanying drawings

DESCRIPTION OF THE PREFERRED EMBODIMENTS

Figure 1:
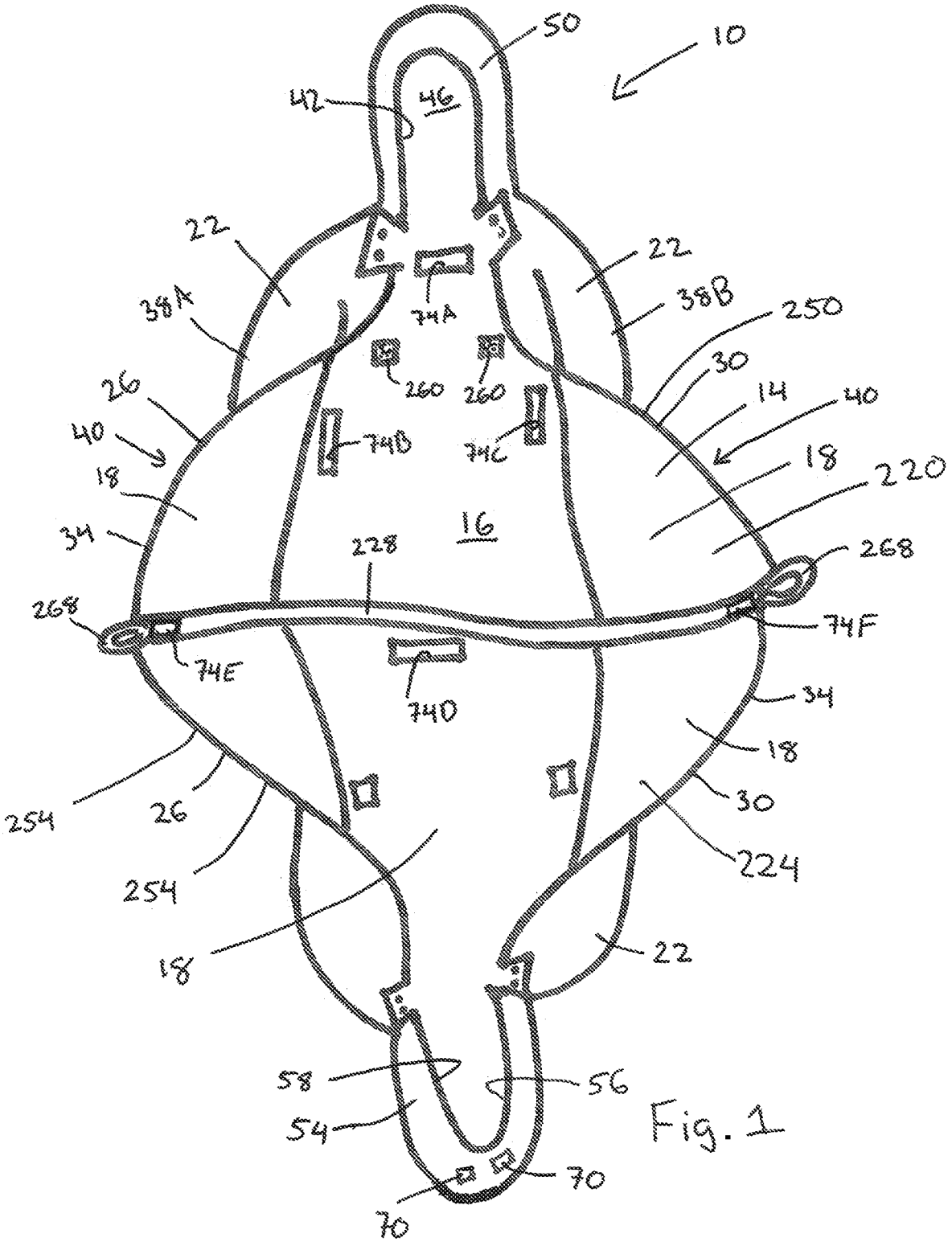
FIG. 1 is a schematic, front view of a garment in an open configuration in accordance with the claimed invention.
Figure 2:
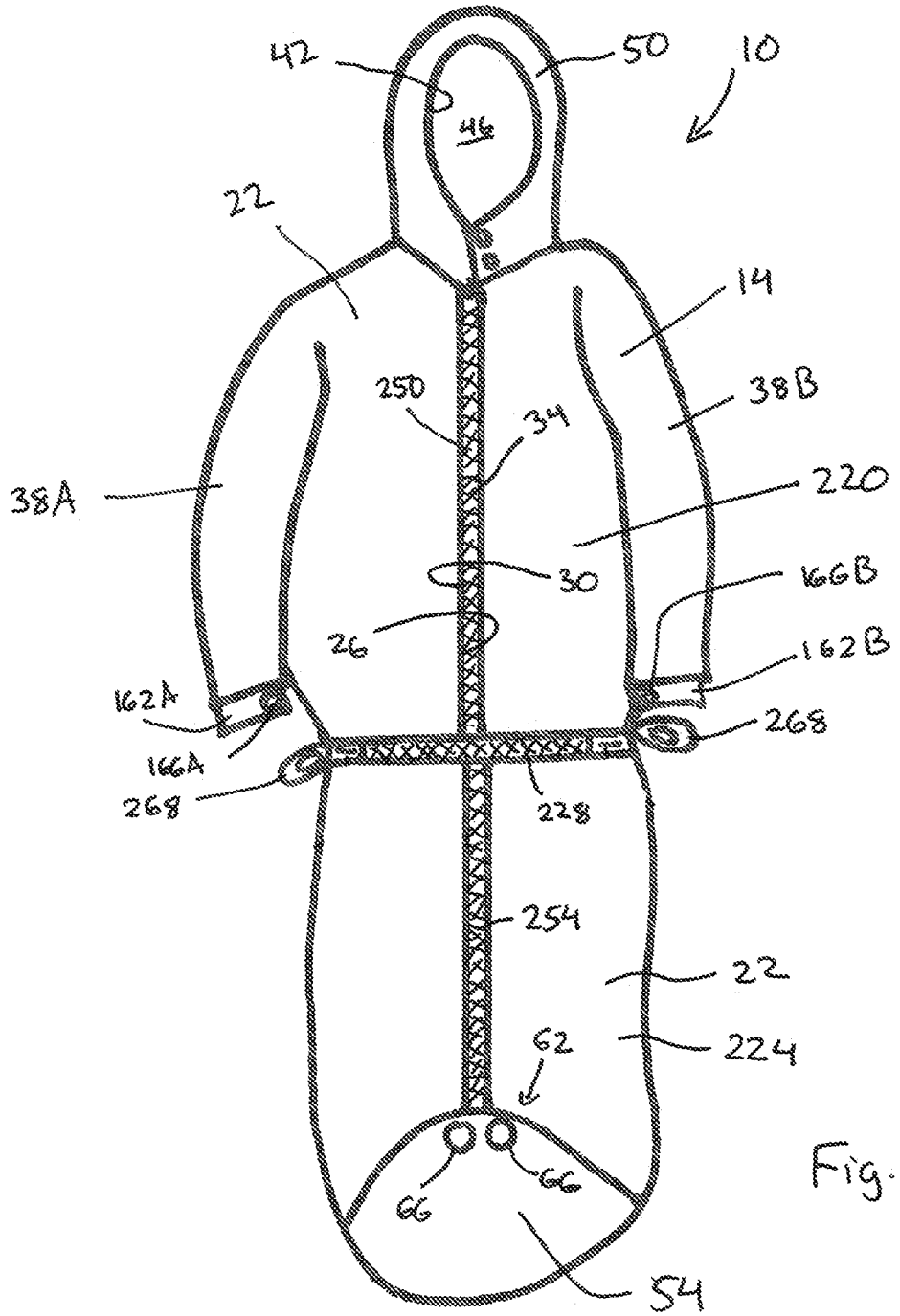
FIG. 2 is a schematic, front view of the garment of FIG. 1 in a closed configuration.
Figure 3:
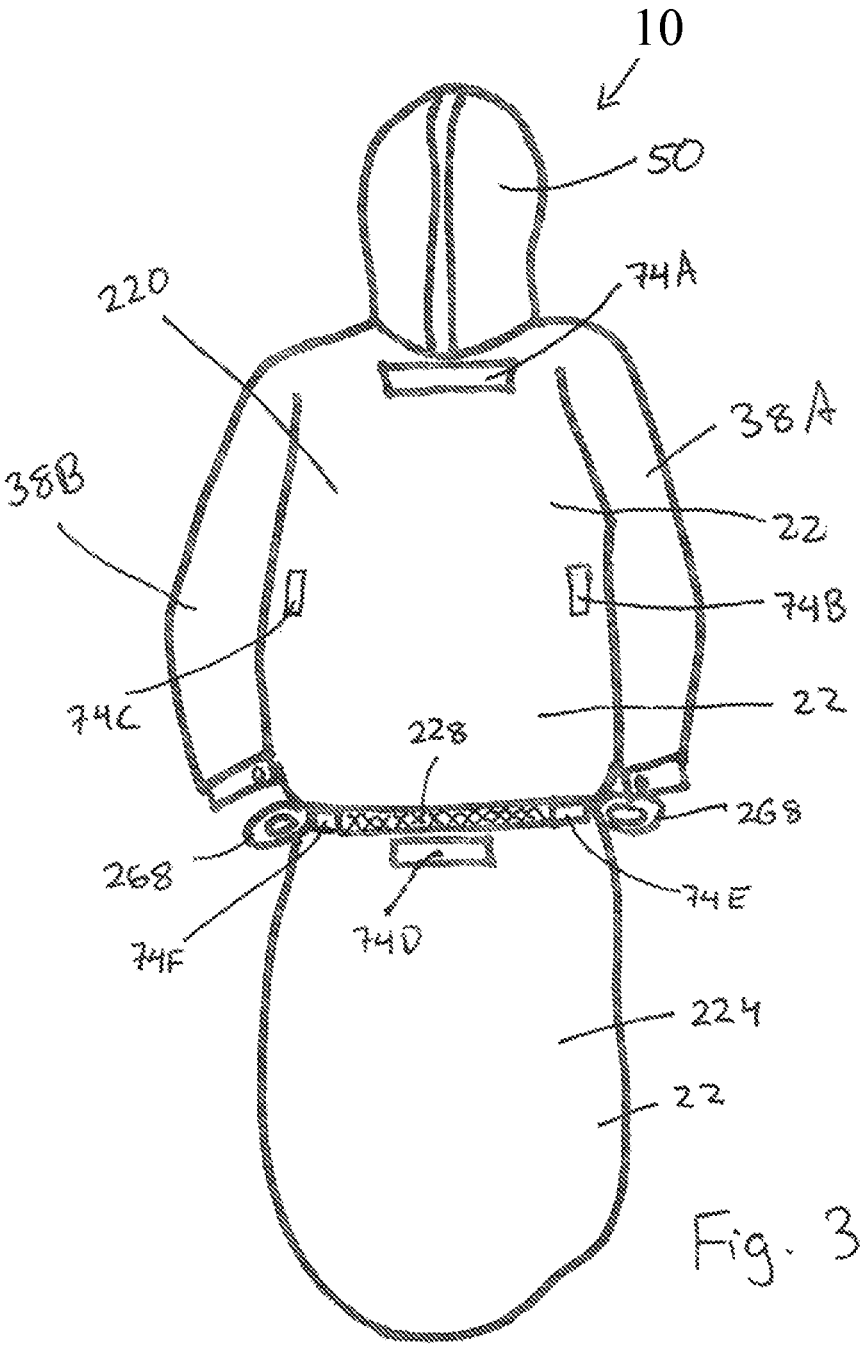
FIG. 3 is a schematic, rear view of the garment of FIGS. 1 and 2.

Referring to the Figures, wherein like reference numbers refer to like components throughout, a garment 10 is schematically depicted. Referring specifically to FIGS. 1-3, the garment 10 includes fabric material 14 shaped and configured to form a cavity or enclosed space 16 to contain the torso, legs, and arms of a human wearer. More specifically, the fabric material 14 defines an inner surface 18 (that defines the space 16) and an outer surface 22. The fabric material 14 also defines a first edge 26 and a second edge 30 that cooperate to define a first opening 34 therebetween and through which the wearer may enter or exit the enclosed space 16. The fabric material 14 also defines sleeves 38A, 38B, each of which defines a respective passageway that forms part of the enclosed space 16 and through which a respective one of the arms of the wearer extends.

The garment 10 is depicted in its open configuration in FIG. 1, i.e., the edges 26, 30 are separated so that the size of the opening 34 is sufficient for a wearer to enter or exit the space 16 through the opening 34. FIG. 2 depicts the garment 10 in its closed configuration. Referring specifically to FIG. 2, the fabric material 14 is movable to close the opening 34. More specifically, the opening 34 may be closed by moving edges 26, 30 together or slightly past each other such that the opening 34 is eliminated or the size of the opening 34 is minimized. The garment 10 includes a first fastening system 40 mounted with respect to the material 14. The fastening system 40 is configured to selectively and releasably secure the edges 26, 30 with respect to one another so that the garment 10 remains in its closed configuration.

Figure 7:
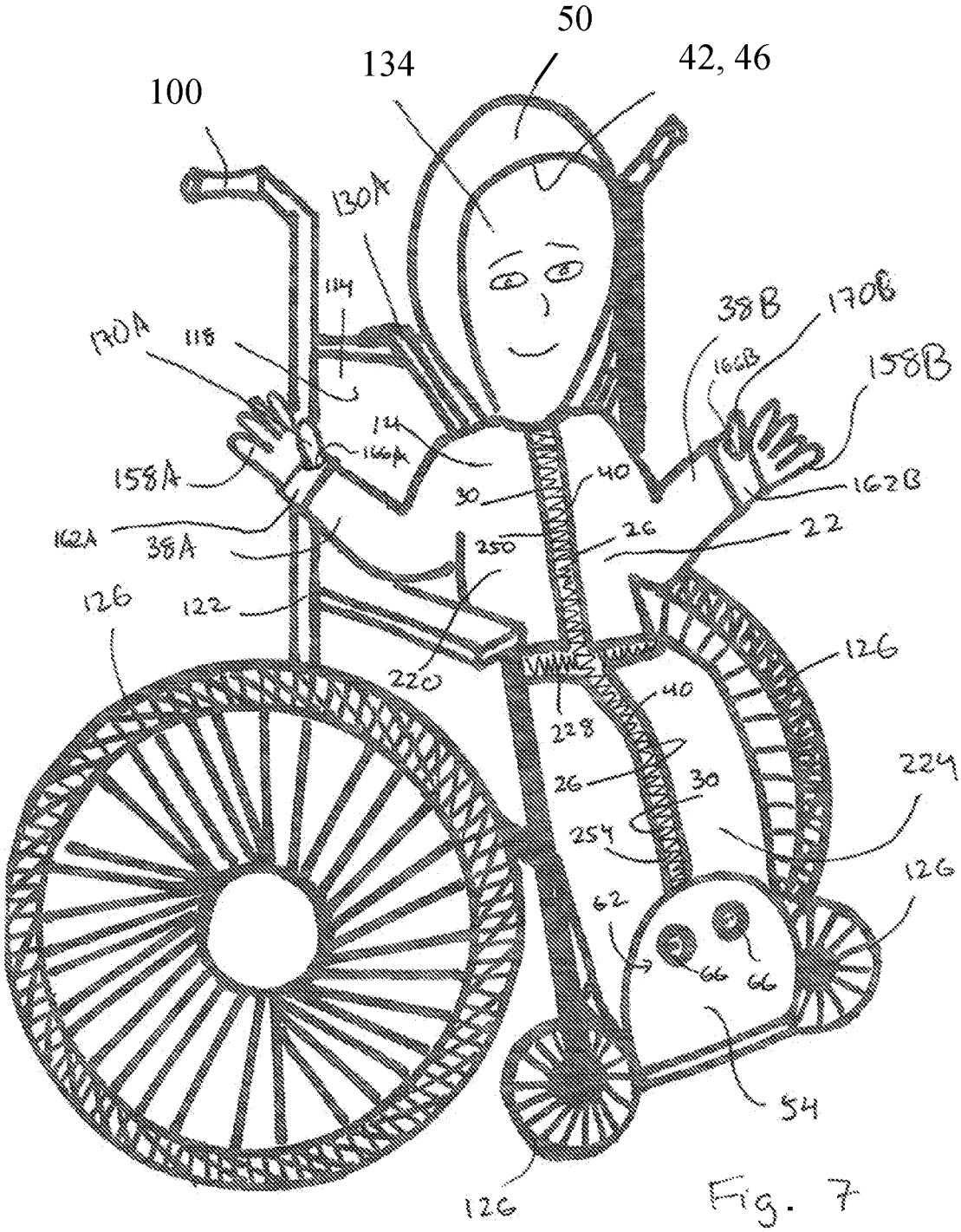
FIG. 7 is a schematic, perspective view of the wheelchair of FIG. 4 with the garment of FIGS. 1-3 installed thereon and in the closed configuration.
Figure 8:
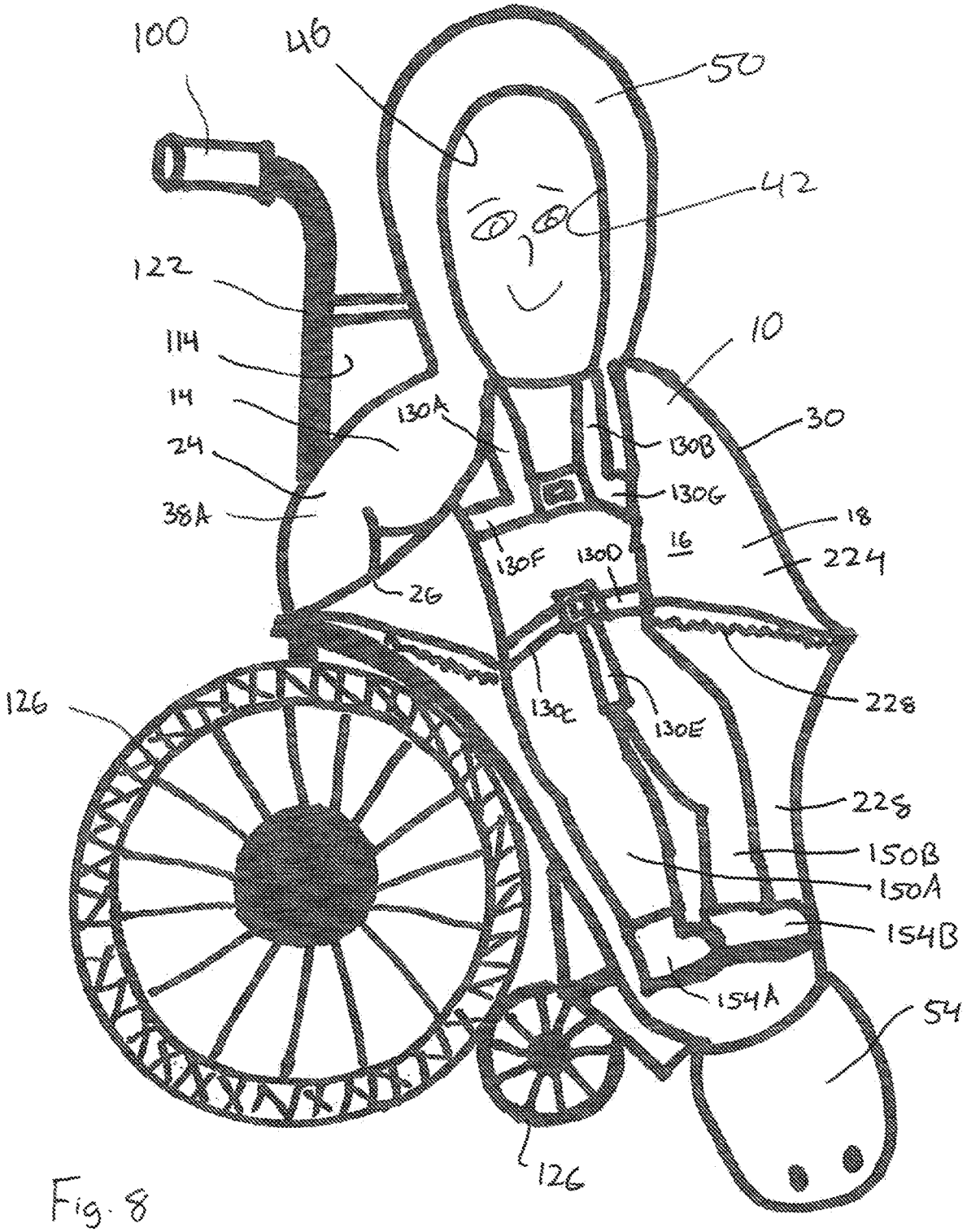
FIG. 8 is a schematic, perspective view of a wheelchair with an alternative harness configuration and the garment installed thereon.
Figure 9:
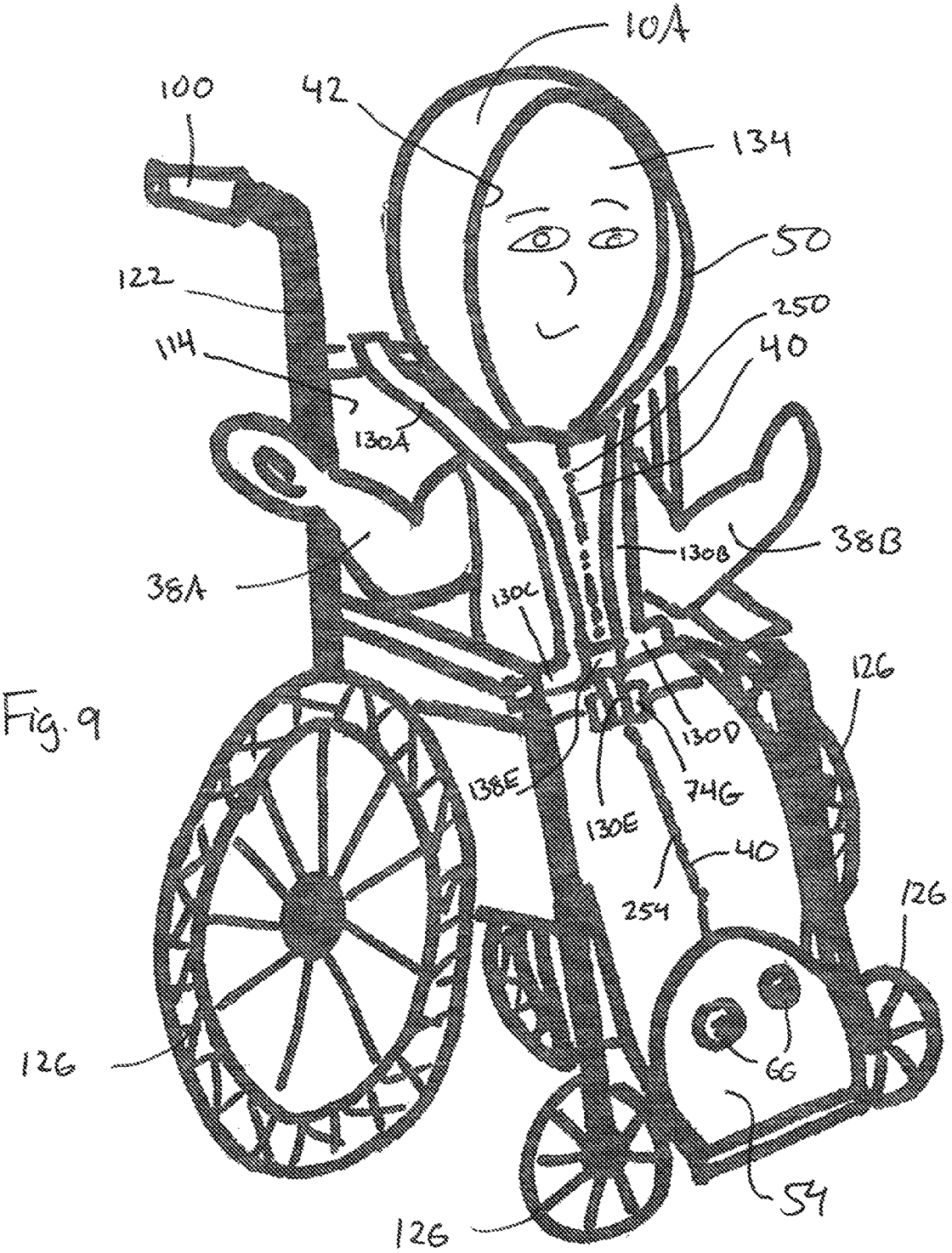
FIG. 9 is a schematic, perspective view of the wheelchair of FIG. 4 and an alternative garment configuration, with the harness restraints connected outside the garment.

The garment 10 is configured such that, when the opening 34 is closed, as shown in FIG. 2, a third edge 42 of the garment 10 defines a second opening 46. In the embodiment depicted, edge 42 is defined by a hood portion 50 of the garment, and is configured to enclose at least a portion of the wearer's head. During use, the wearer's face is exposed through opening 46 (as shown in FIGS. 7-9). Alternatively, and within the scope of the claimed invention, the garment 10 may not have a hood portion, and edge surface 42 would define an opening though which the wearer's neck extends so that the wearer's head is outside space 16 and exposed.

Edge 42 interconnects edges 26, 30; accordingly, when the garment 10 is in its open configuration, opening 34 and opening 46 are contiguous.

Referring again to FIGS. 1 and 2, the material 14 also includes a flap 54 at the opposite end of the opening 34 from opening 46. Flap 54 has a third edge 56 that defines a third opening 58. Edge 56 interconnects edges 26, 30; accordingly, opening 58 is contiguous with opening 34 when the garment 10 is in its open configuration. In FIG. 1, the flap 54 is shown in an open position in which the opening 58 is unobstructed. The flap 54 is foldable to a closed position such that the flap 54 closes (i.e., covers or obstructs) the third opening 58, as shown in FIG. 2. A second fastening system 62 is mounted with respect to the material 14. The fastening system 62 is configured to selectively secure the flap 54 in its closed position (in which the flap 54 obstructs or obscures the opening 58). In the embodiment depicted, the fastening system 62 includes buttons 66 that are mounted to the fabric material 14 and that are engageable with holes 70 in the flap 54. Other fastening systems may be employed within the scope of the claimed invention, such as, but not limited to, hook and loop fasteners, snaps, etc.

Referring to FIGS. 1 and 3, the fabric material 14 defines a plurality of holes or slots 74A, 74B, 74C, 74D, 74E, 74F in the back of the garment 10. Each of the slots 74A-F extends through the fabric material 14 from the outer surface 22 to the inner surface 18.

Figure 4:
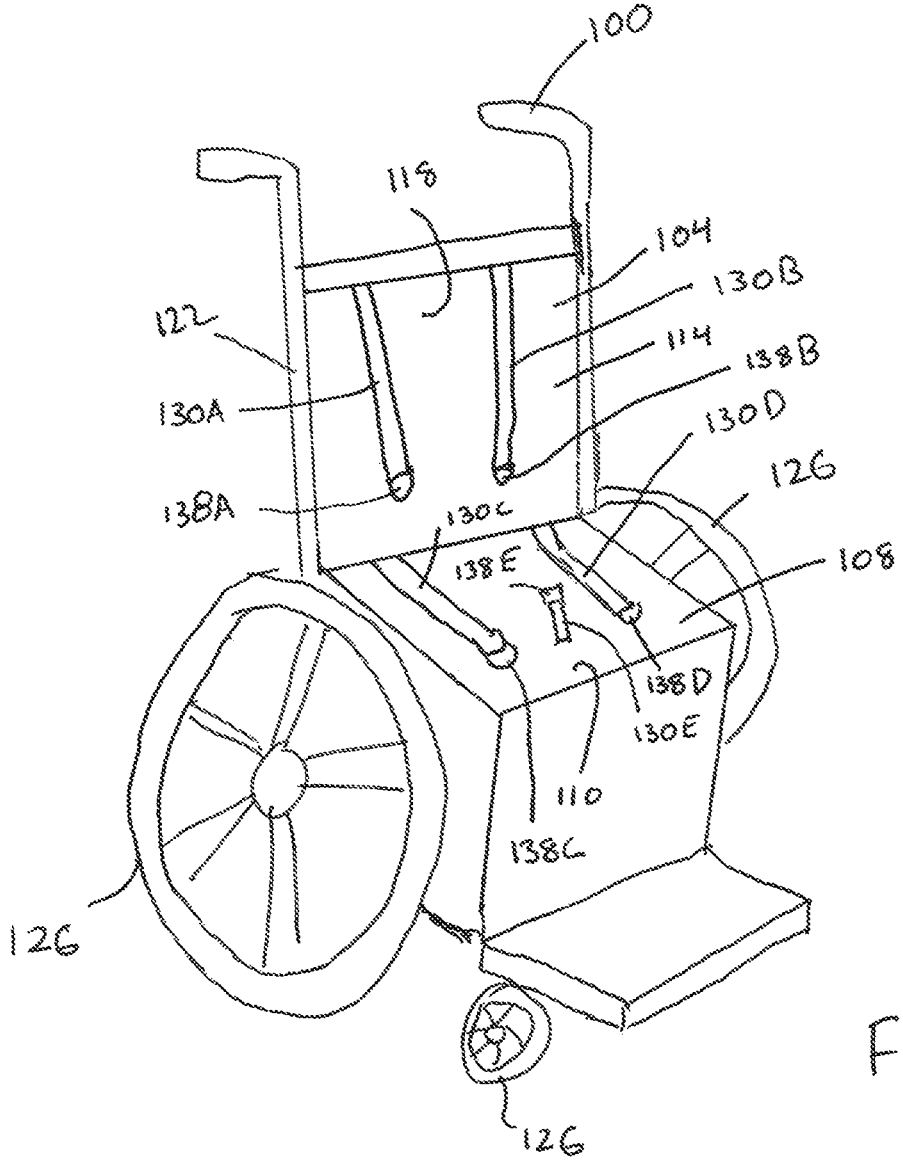
FIG. 4 is a schematic, perspective view of a wheelchair having harness restraints mounted thereto.

Referring to FIG. 4, the garment 10 is advantageously usable with a seat having harness straps, such as the wheelchair shown at 100. The wheelchair 100 includes a seat assembly 104, which has a lower seat portion 108 that defines an upwardly-facing surface 110 for supporting an occupant. The seat assembly 104 also includes a seatback portion 114, which defines a generally vertical surface 118 for supporting the back of an occupant. The seat assembly 104 is mounted to a frame 122, which is rotatably connected to a plurality of ground-engaging wheels 126, as understood by those skilled in the art. The wheelchair 100 also includes a plurality of harness straps 130A-E that are operatively connected to the frame 122 and mounted with respect to the seat assembly 104 for securing an occupant to the wheelchair 100.

In the embodiment depicted, straps 130A, 130B are first and second shoulder straps that are configured to extend over respective shoulders of the occupant 134. Straps 130C, 130D are first and second lap belts that are configured to extend transversely across the occupant's body at or near the occupant's hips (shown at 146A, 146B in FIG. 6). Strap 130E is a pommel strap that is positioned and configured to extend upward between the legs (shown at 150A, 150B in FIG. 6) of the occupant 134.

A method of use for the garment 10 is shown in FIGS. 4-7. The method includes possessing a seat assembly 104, such as the seat assembly of wheelchair 100. The seat assembly 104 has a lower seat portion 108, a seatback portion 114, and a plurality of harness straps 130A-E mounted with respect thereto. The method also includes possessing a garment 10 having an inner surface 18, an outer surface 22, a first edge portion 26, a second edge portion 30, and defining a plurality of slots 74A-E that extend through the garment 10 from the inner surface 18 to the outer surface 22, such as the garment 10 shown in FIGS. 1-3.

Figure 5:
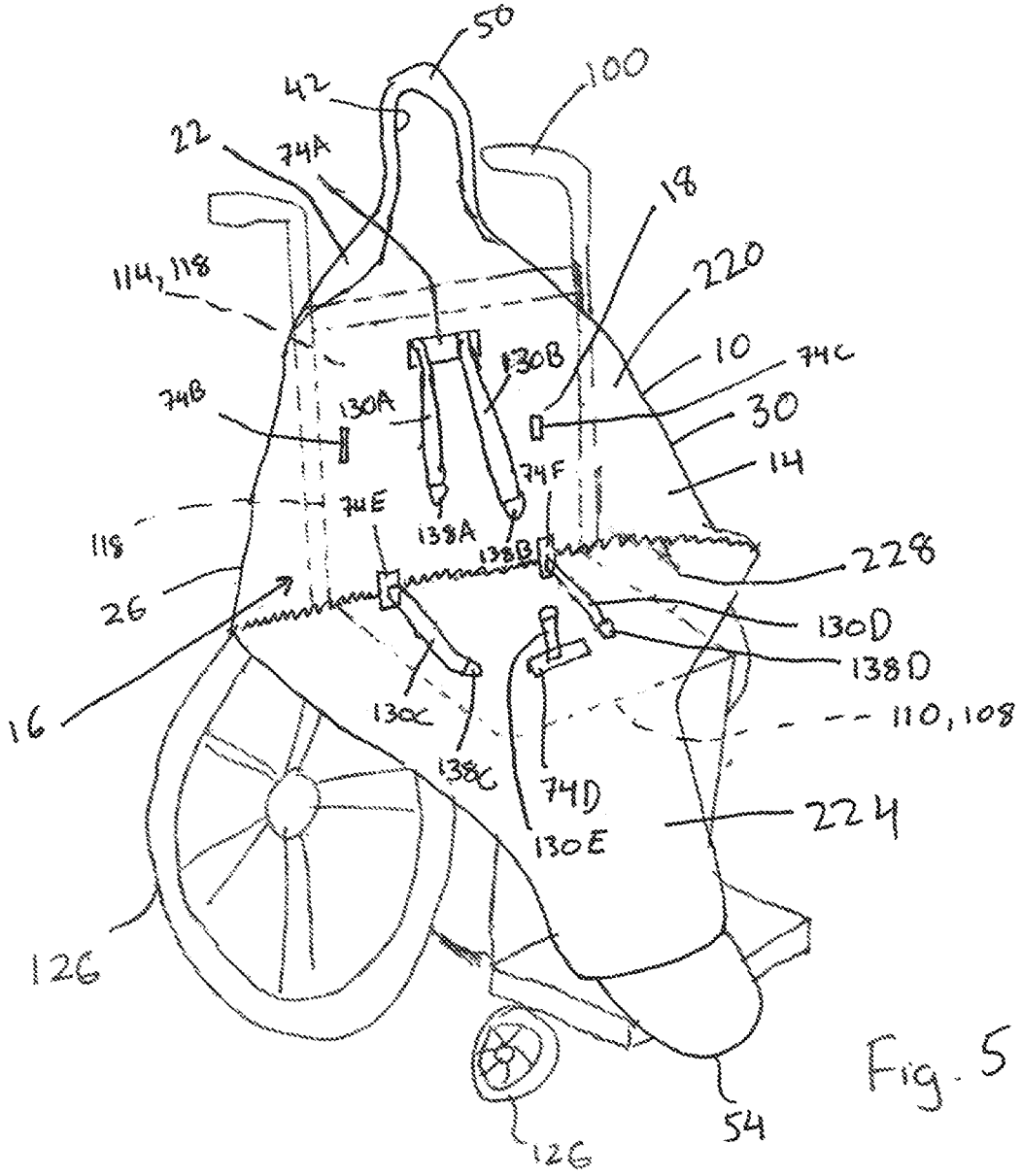
FIG. 5 is a schematic, perspective view of the wheelchair of FIG. 4 with the garment of FIGS. 1-3 installed thereon and in the open configuration.

Referring specifically to FIG. 5, the method further includes positioning the garment 10 such that the outer surface 22 is in contact with the lower seat portion 108 and the seatback portion 114, as shown in FIG. 5. More specifically, the outer surface 22 contacts portions of surface 110 and surface 118. The method also includes extending each of the harness straps 130A-E through a respective one of the slots 74A-E such that each strap 130A-E is at least partially disposed inside the space 16. More specifically, in the embodiment shown, the method includes inserting the first and second shoulder straps 130A, 130B through a first slot 74A, inserting the pommel strap 130E through a second slot 74D, inserting the first lap belt 130C through a third slot 74E, and inserting the second lap belt 130D through a fourth slot 74F such that straps 130A, 130B extend through slot 74A; strap 130C extends through slot 74E; strap 130D extends through slot 74F; and strap 130E extends through slot 74D.

Figure 6:
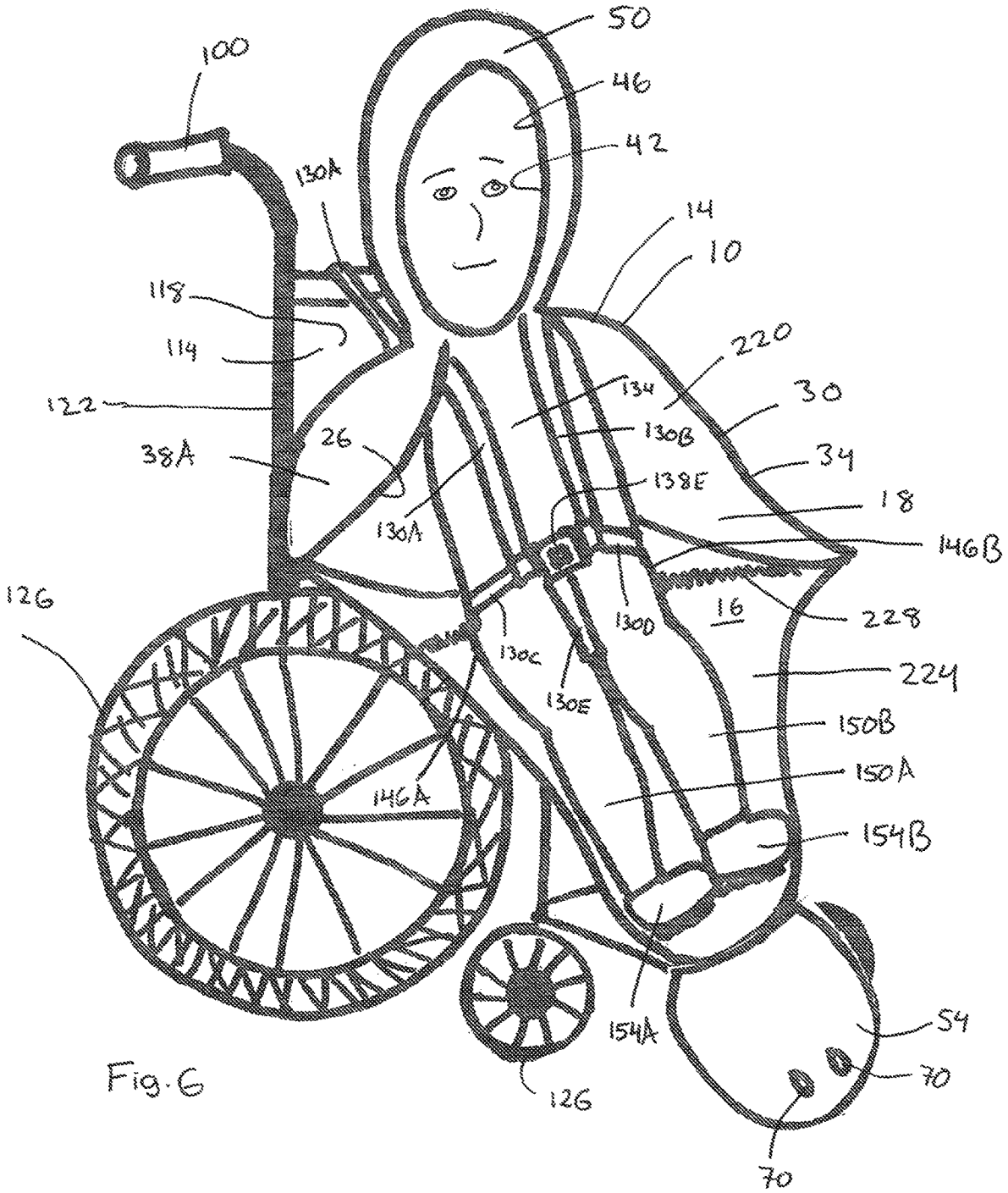
FIG. 6 is a schematic, perspective view of the wheelchair of FIG. 4 with the garment of FIGS. 1-3 installed thereon with the harness restraints securing an occupant.

Following extending the harness straps 130A-E through the slots 74A, 74D, 74E, 74F, the method further includes placing a human wheelchair occupant 134 on the inner surface 18 of the garment 10, as shown in FIG. 6. Referring to FIG. 6, following placing the occupant 134 on the inner surface 18, the method includes fastening each of said harness straps 130A-E to at least one of the other harness straps 130A-E such that the occupant 134 is between the straps 130A-E and the inner surface 18, and the occupant 134 is thereby secured to the wheelchair 100. As best seen in FIG. 4, in the embodiment depicted, each of the straps 130A-E has a respective latching element 138A-E mounted thereto. Each latching element 138A-E is releasably engageable with one of the other latching elements to fasten each of the straps 130A-E to at least one of the other straps 130A-E. Those skilled in the art will recognize a variety of latching elements 138A-E that may be employed within the scope of the claimed invention, such as, but not limited to, buckles or clasps.

Following fastening each of the harness straps 130A-E to at least one of the other harness straps 130A-E, the method includes closing the first opening 34 of the garment 10 by securing the first edge 26 adjacent to the second edge 30, as shown in FIG. 7. Securing the first edge 26 adjacent to the second edge 30 may be accomplished by engaging the fastening system 40. The method may also include closing the third opening 58 by moving the flap 54 to its closed position and engaging fastening system 62 to retain the flap in the closed position, as shown in FIG. 7. With the openings 34, 58 closed, the occupant's torso, arms, legs, and feet are enclosed within the space 16 and surrounded on the front, back, and sides by the material 14, and are therefore protected from cold, rain, snow, wind, etc.

It should be noted that the feet (shown at 154A, 154B in FIG. 6) are easily accessible through the third opening 58 by disengaging the fastening system 62 and moving the flap 54 to its open position. Each of the occupant's arms extends through a respective one of the sleeves 38A, 38B such that a respective one of the occupant's hands 158A, 158B protrudes from the terminal end of each sleeve. Referring to FIGS. 2 and 7, each sleeve 38A, 38B includes a respective cuff 162A, 162B that defines its respective terminal end. Each cuff 162A, 162B defines a respective hole 166A, 166B. The occupant 134 has two thumbs 170A, 170B. Each thumb 170A, 170B may extend through a respective one of the holes 166A, 166B, as shown in FIG. 7.

Referring to FIG. 8, wherein like reference numbers refer to like components from FIGS. 1-7, the garment 10 is shown in use with an alternative harness strap configuration. More specifically, wheelchair 100 has shoulder straps 130A, 130B, pommel strap 130E, and lap belts 130C, 130D mounted thereto, as in FIG. 4. However, additional straps 130F, 130G are mounted to the wheelchair 100 and extend through slots 74B and 74C (shown in FIGS. 1, 3, and 5), respectively.

Referring to FIG. 9, an alternative garment 10A is schematically depicted installed on wheelchair 100 and in its closed configuration, i.e., openings 34 and 58 are closed. Garment 10A is identical to garment 10, except that garment 10A defines slot 74G. Slot 74G is formed in the front of the garment 10A. As shown in FIG. 9, pommel strap 130E extends through both slots 74D and 74G and the enclosed space formed by the inner surface of the garment 10A so that the fastening element 138E is exposed outside the space 16. This permits the fastening of the straps 130A-E outside of the garment 10A and after the garment 10A has been closed, as shown in FIG. 9. In the arrangement of FIG. 9, straps 130A-D do not extend through any of the holes 74A-G or through the space 16, but instead remain outside the garment 10A.

Figure 10:
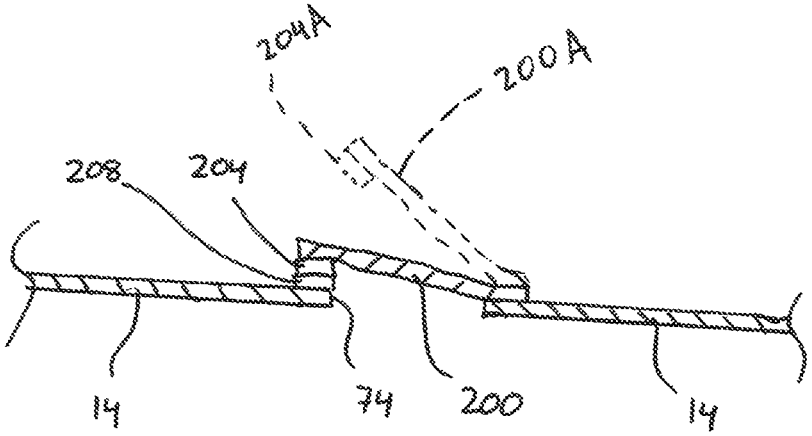
FIG. 10 is a schematic, cross-sectional side view of a slot representative of the slots formed in the garment.

Referring to FIG. 10, wherein like reference numbers refer to like components from FIGS. 1-9, material 14 defining a slot 74 is schematically depicted. Slot 74 is representative of slots 74A-G. A closure 200 is fastened to material 14 on one side of, and adjacent to, slot 74. A first fastening element 204 is mounted to the closure 200. A second fastening element 208 is mounted to the material 14 on the side of the slot 74 opposite the side at which the closure is fastened to the material 14. The closure 200 in the embodiment depicted is a flexible fabric, and is selectively movable between an open position (shown in phantom at 200A) in which the slot 74 is open and unobstructed by the closure 200, and a closed position, in which the closure 200 covers and obstructs the slot 74. The first and second fastening elements 204, 208 are engageable with each other when the closure 200 is in the closed position, thereby releasably retaining the closure 200 in the closed position. Fastening element 204 moves with the closure to the position shown in phantom at 204A.

The closure 200 reduces or eliminates heat loss through the slot 74 when the slot 74 is not being employed to route a harness strap. A user may disengage the fastening elements 204, 208 to move the closure to the open position for routing a strap. Those skilled in the art will recognize a variety of fastening elements 204, 208 that may be employed, such as snaps, hooks and loop, buttons, zippers, etc.

Referring again to FIGS. 1 and 6-7, the garment 10 may be substantially one piece of fabric material 14, or the fabric material 14 may comprise multiple pieces 220, 224 that are operatively connected to each other. In the embodiment depicted, piece 220 defines the portion of the garment 10 configured to enclose the torso and arms of the wearer (i.e., sleeves 38A and 38B are part of piece 220), and piece 224 defines the portion of the garment 10 configured to enclose the legs and feet (150A-B, 154A-B, respectively) of the wearer. The two pieces 220, 224 are releasably connected to each other by a fastening system 228, which, in the embodiment depicted, is a zipper. In this way, piece 224 is selectively removable so that piece 220 may be worn or employed as a coat. Accordingly, the fastening system 40 includes a first zipper 250 for the portions of edges 26, 30 defined by piece 220, and a second zipper 254 for the portions of edges 26, 30 defined by piece 224. It should be noted that, in the case of a zipper or certain other fastening systems, the fastening system may at least partially define the edges 26, 30.

The garment 10 also includes fastening elements 260 on the inner surface 18 for releasably connecting an optional liner. Tags 268 may be mounted to the outer surface 22 adjacent to slots 74E, 74F to assist a user in locating the slots 74E, 74F during installation of the harness straps.

Those skilled in the art will recognize a variety of materials that may be employed as fabric material 14 within the scope of the claimed invention. In one embodiment, the material 14 is a single layer of material, such as wool, polyester, nylon, etc. In another embodiment, material 14 includes multiple layers, such as an inner liner that defines the inner surface 18, an outer shell that defines outer surface 22, and insulative material between the inner liner and outer shell, such as down, fiber fill, etc. The material 14 may also vary in composition in different sections of the garment 10; for example, and within the scope of the claimed invention, the sleeves may include a liner material different from the remainder of the garment, additional and/or different insulation layers may be employed within different sections of the garment, etc.

While the best modes for carrying out the invention have been described in detail, those familiar with the art to which this invention relates will recognize various alternative designs and embodiments for practicing the invention within the scope of the appended claims.

The invention claimed is:

1. A garment for an occupant of a seat assembly, the seat assembly having a lower seat portion, a seatback portion, and first and second shoulder straps mounted with respect to the lower seat portion and the seatback portion, the occupant having a torso, arms, and legs, the garment comprising:

a piece of fabric material defining an inner surface, an outer surface, a first edge, and a second edge;

wherein the piece of fabric material is configured such that the inner surface defines an enclosed space having an opening between the first and second edges, said enclosed space being configured to enclose at least the torso and arms of the occupant;

wherein the garment is movable from an open configuration, in which the first and second edges are separated, to a closed configuration, in which the first and second edges are adjacent one another; and wherein the piece of fabric material defines a slot that extends from the inner surface to the outer surface, said slot being sufficiently sized and positioned such that the first and second shoulder straps are insertable through the slot when the garment is on the seating assembly.

2. The garment of claim 1, wherein the piece of fabric material defines sleeves.

3. The garment of claim 2, further comprising at least a portion of a fastening system operatively connected to the piece of fabric material; said fastening system being configured to releasably connect another piece of fabric material to the piece of fabric material; said other piece of fabric material being configured to enclose the legs of the occupant.

4. The garment of claim 3, further comprising the other piece of fabric material operatively connected to the piece of fabric material by the fastening system.

5. The garment of claim 4, wherein the fastening system is a zipper.

6. A method for use with a seat assembly having a lower seat portion, a seatback portion, and first and second shoulder straps mounted with respect to the lower seat portion and the seatback portion, the method comprising:

positioning a garment having an outer surface such that the outer surface contacts the lower seat portion and the seatback portion, said garment also having an inner surface, and defining a slot that extends through the garment from the outer surface to the inner surface; and extending the first and second shoulder straps through the slot.

7. The method of claim 6, wherein the inner surface defines an enclosed space;

wherein the garment includes first and second edges that define an opening to the enclosed space therebetween;

wherein the method further comprises fastening each of said first and second shoulder straps to at least one other strap mounted with respect to the seat assembly when an occupant is on the inner surface.

8. The method of claim 7, wherein the garment defines another slot; and wherein the method further comprises extending said at least one other strap through said other slot prior to said fastening each of the first and second shoulder straps to at least one other strap.

9. The method of claim 8, wherein said at least one other strap includes a pommel strap.

* * * * *